US005383304A

United States Patent [19]

Codina Soley

[11] Patent Number: 5,383,304

[45] Date of Patent: Jan. 24, 1995

[54] SLIDING DOORS

[76] Inventor: Antonio Codina Soley, Sant Quirze No. 11, 08201 Sabadell, Barcelona, Spain

[21] Appl. No.: 107,080

[22] Filed: Aug. 17, 1993

[30] Foreign Application Priority Data

Oct. 6, 1992 [ES] Spain ..... 9201975
Feb. 24, 1993 [ES] Spain ..... 9300362

[51] Int. Cl.[6] ..... E05D 15/10

[52] U.S. Cl. ..... 49/215; 49/211; 49/210

[58] Field of Search ..... 49/139, 209, 211, 213, 49/214, 215, 216, 218, 221, 254, 257, 258, 259, 260, 261, 360, 449

[56] References Cited

U.S. PATENT DOCUMENTS 1,424,311 8/1922 Kunz ..... 49/212
2,878,533 3/1959 Beauchamp ..... 292/36 X
4,337,596 7/1982 Kern et al. ..... 49/215 X
4,362,328 12/1982 Tacheny et al. ..... 292/36
4,606,146 8/1986 Jozefozak ..... 49/216
4,617,756 10/1986 Dilcher ..... 49/215 X
4,924,625 5/1990 Dilcher ..... 49/212
4,932,715 6/1990 Kramer ..... 49/215 X

*Primary Examiner*—Peter M. Cuomo
*Assistant Examiner*—Jerry Redman
*Attorney, Agent, or Firm*—Jacobson, Price, Holman & Stern

[57] ABSTRACT

A device is disclosed for the automatic operation of a sliding door particularly a sliding door of a vehicle which in a final closure phase follows a path which is arcuate or inclined with respect to the longitudinal direction of closure. An endless belt is provided, to which the door is fixed, and the belt is mounted between two pulleys. One of the pulleys has a fixed position with respect to the door frame, and the other pulley can be displaced between limits on a pivoted arm, suitably guided, so as to accommodate the transverse movement of the door relative to the door frame.

14 Claims, 4 Drawing Sheets

SLIDING DOORS

BACKGROUND OF THE INVENTION

The present invention relates to apparatus for the automatic operation of sliding doors, particularly sliding doors of motor vehicles.

An increasing number of motor vehicles, such as, for example, small trucks, vans and motor coaches of small capacity, are equipped with sliding doors having a compressed air or other installation to operate the door(s) automatically. In these vehicles there is commonly a side door which is displaced along a longitudinal plane parallel and close to that of the side wall of the bodywork, with which it is brought flush on reaching the closed position by means of a final phase of combined movement in the longitudinal and transverse directions.

None of the known automatic operating systems have proved to be completely satisfactory for application to such vehicles and, when destined for the conveyance of passengers, it is generally a statutory requirement for such vehicles to be equipped with an automatic system for operating the doors.

SUMMARY OF THE INVENTION

In accordance with the invention, the apparatus is provided for the automatic opening and closure of a sliding door of the type in which movement between the open and closed positions comprises a longitudinal movement substantially parallel to the door and a transverse movement perpendicular thereto. The apparatus comprises an endless belt to which the door is coupled and which is driven to effect opening or closure of the door. The belt extends between two pulleys wherein the axle of the first pulley is fixed in relation to the door frame and the axle of the second pulley is capable of moving along an arcuate path towards and away from the door frame.

Such an automatic operating apparatus may be used with substantially every class of motor coach, motor bus and similar vehicle in which, at present, operation of the doors is effected pneumatically, making use of the compressed air installation already existing in the vehicle. Pneumatically-operated doors have a number of disadvantages such as, for example, installation costs, space necessary for their movement, difficulty in being integrated into the aerodynamic line of the vehicle, etc. Apparatus in accordance with the invention can be applied to all these vehicles, both to newly constructed vehicles and also to vehicles already in operation.

As has already been indicated, the operating device which is the object of the invention is intended for the operation of sliding doors, of a type already known per se, which are subjected in at least one phase of their displacement between the closed and open positions, to a combined movement which has an orthogonal component with respect to the main direction of displacement. Such doors, starting from the open position, are displaced and guided, parallel to the side of the bodywork of the vehicle, as far as a final phase in which they approach the bodywork transversely, until they fit in the closed position flush with the bodywork.

Preferably, this combined displacement of the doors, following the said guides, between the closed and open positions is brought about by means of the endless belt which may be operated by an electric motor, the belt being suitably tensioned between two pulleys, one of which is mounted so that the position of its axle remains fixed with respect to the chassis of the vehicle, while the axle of the other pulley can carry out certain displacements which are duly guided with respect to the chassis, keeping parallel to itself and varying its distance with respect to the side of the bodywork of the vehicle. The axle of one of the pulleys may be mounted to a support which is fixed rigidly to the vehicle, while the axle of the other pulley may be mounted to a support in the form of a rocking arm which can experience a certain rotational movement with respect to the fixed support, adapting itself to the combined movement to which the door is subjected.

Embodiments in accordance with the invention may also be provided with additional features directed, in a particular manner, to the adaptation of the operating system to motor coaches, motorbuses and similar vehicles. These additional features refer particularly to the provision of an intermediate guide, of special structure, which makes it possible to operate the door by its central region and not by the lower part; to the provision of a clutch system which makes it possible to nullify the automatic operating system, in the event of failure; and to the provision of a special system of manual operation, which can be actuated from outside the vehicle.

BRIEF DESCRIPTION OF DRAWINGS

The invention will now be described by way of example and with reference to the accompanying drawings, in which.

DESCRIPTION OF PREFERRED EMBODIMENTS

Figure 1:
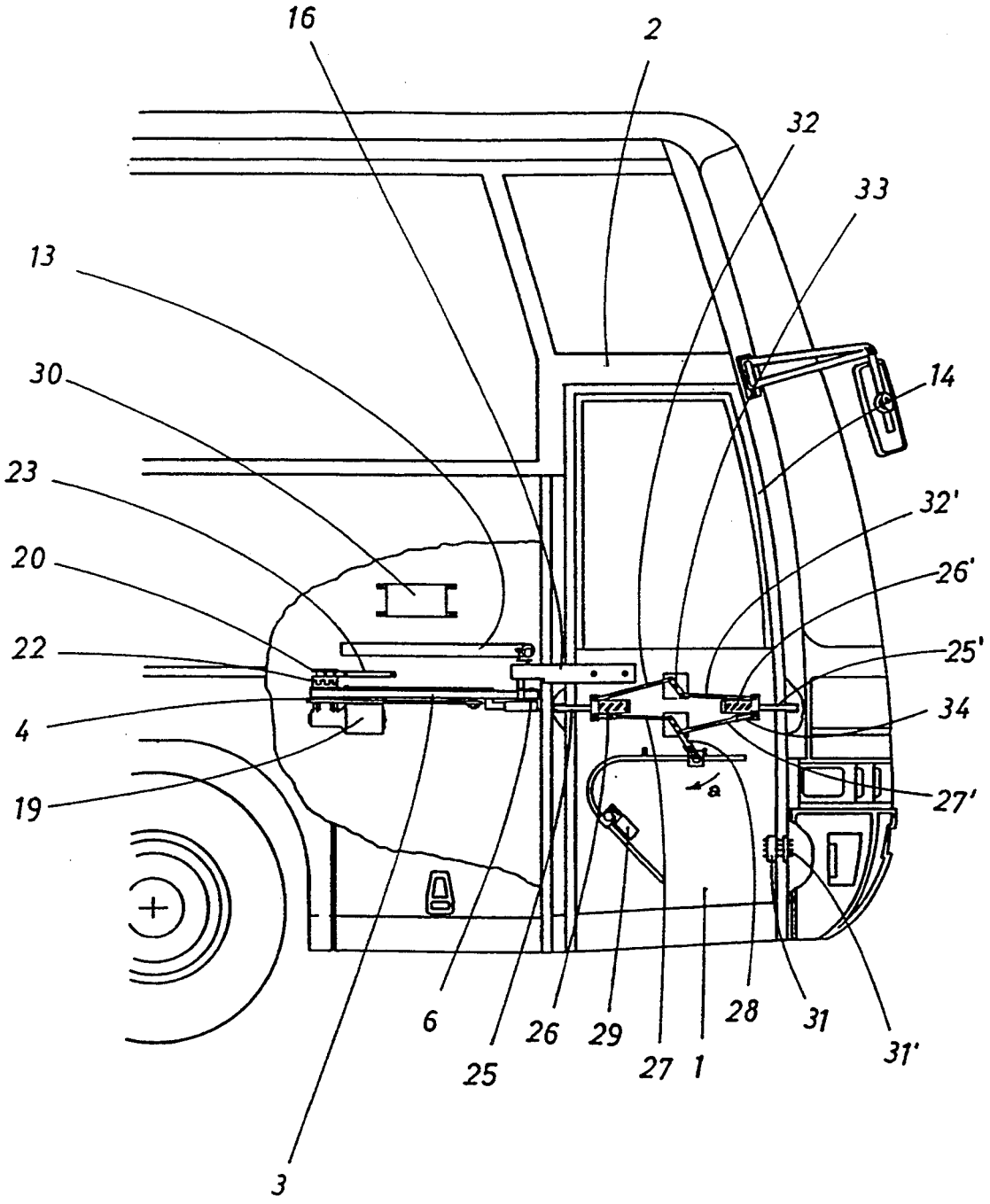
FIG. 1 is a side view, partially in cross-section, of the front part of a motor coach having an apparatus for the automatic operation of a sliding door in accordance with the invention, the door being shown in the closed position.

FIG. 1 shows the front part of a motor coach with a sliding door 1 shown in the closed position and flush with the bodywork 2 of the coach.

The operation of the sliding door 1, bringing about its movements with respect to the bodywork 2, between the open and closed positions, is effected by means of a mechanism which basically comprises an endless belt 3, in general toothed, which is duly stretched between a fixed pulley 4, the axle 5 of which is maintained in a fixed position with respect to the said bodywork (or with respect to the chassis of the vehicle) and a pulley 6, the axle 7 of which is capable of a certain amount of movement with respect to the fixed components. The fixed pulley 4 is mounted on a support 8 fixed to the bodywork or to the chassis of the vehicle, and the pulley 6 is mounted to the end of a horizontal arm 9, which is preferably telescopic so as to facilitate the tensioning of the belt, and which can pivot on an axle 10 fixed to the support 8, the pivotal movement being guided and limited by a pin 11 which slides along an arcuate groove or slot 12 in the support 8.

In its displacements between the closed and open positions the door 1 is guided by an upper guide and a lower one, which are not shown because they are in themselves not part of the invention and can be of any known structure which is considered suitable. Further, vehicles to which the apparatus in accordance with the invention is to be applied are usually already equipped in the factory with such guides. Therefore, in many small trucks, vans and small motor buses, the apparatus in accordance with the invention can be mounted directly to the lower part of the chassis, the system of guides with which the vehicle is already equipped being preserved without any modification or addition. On the other hand, in motor coaches and motor buses of normal dimensions sufficient space will normally exist to be able to mount the operating mechanism, not under the chassis, but at an intermediate height, which will make it possible to operate the door by its central region, with considerable advantages. In this case, apart from the said upper and lower guides (not shown), a central guide 13 may be provided, with the same configuration as the upper and lower guides. Guided in this way, the door 1 carries out a compound movement which, from the open position, comprises a longitudinal portion, parallel to the side of the bodywork 2, corresponding to the longitudinal section of the guide 13, then moves through a curve of approximately 90°, corresponding to the curved portion 13', of the guide 13, and then moves along a final short path perpendicular or slightly inclined with respect to the side of the bodywork 2 corresponding to the final transverse section 13'' of the guide 13, the door finally being fitted and applied with a certain pressure against a fixed door frame 14. In moving from the closed position to the open one, these movements are reversed, the door 1 first separating itself from the frame 14 and then being displaced along the side of the bodywork 2, at a distance from this side.

Figure 5:
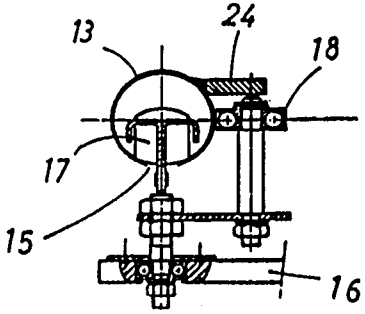
FIG. 5 is a view on a larger scale, along the line A—A, in FIG. 4.

The guide 13 has a structure which makes it possible to confer on it easily the curvature 13, according to the relatively small radius which the opening and closing movements require. The guide 13 is made from a tube (see FIG. 5), of circular cross-section, in which, once it has been brought to its final configuration, a longitudinal groove 15 is formed, for example, by milling or by means of cutting with laser beams.

The door 1 is provided with a support 16 which is fixed by its free end to a point of the belt 3, so that the movements of the belt 13 are translated into displacements of the door 1 along the guides. The support 16 is mounted to the guide 13 by means of one or more rollers 17 which may be displaced along the guide. The support 16 also comprises a roller 18 which rests against the side of the guide 13, completing the effect developed by this latter and, above all, preventing any decentring of the main rollers 17 during the movement of the roller 18 along the curved section 13' of the guide 13.

The resistance offered by the door 1 to displacement between the closed and open positions will be relatively reduced if the door 13 is balanced so as to reduce the frictional resistance against sliding along the guide 13. In the final part of the closing movement a certain resistance arises, due to the door having to be applied with a certain pressure against an elastic door seal lining the fixed frame 14. To take account of this resistance, and to prevent any possibility of slippage of the belt 3 with respect to the fixed pulley 4 during this final closure movement, the configuration is such that, on reaching the closed position, the axles 5, 10 and 7 are substantially aligned, conferring on the belt 13 its maximum tension (see FIG. 3).

Figure 3:
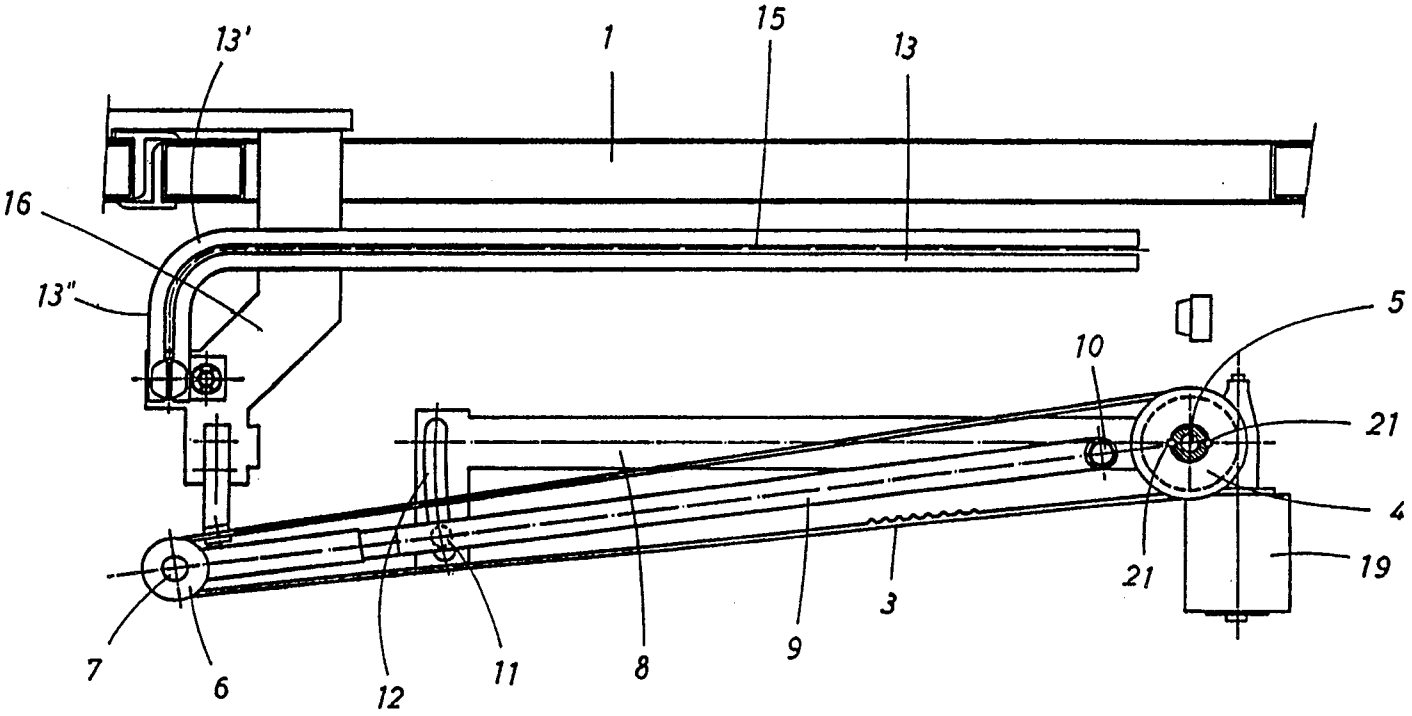
FIGS. 3 and 4 are plan views, on a larger scale, of the apparatus shown in FIGS. 1 and 2 with the door shown in the closed and open positions respectively.
Figure 6:
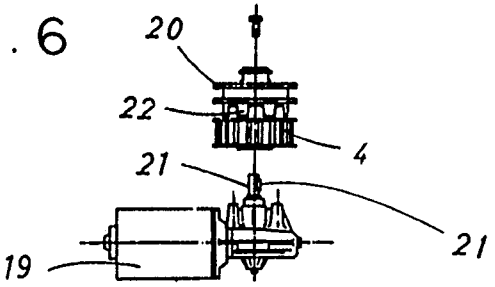
FIG. 6 is an exploded view of part of a drive unit for the door.
Figure 4:
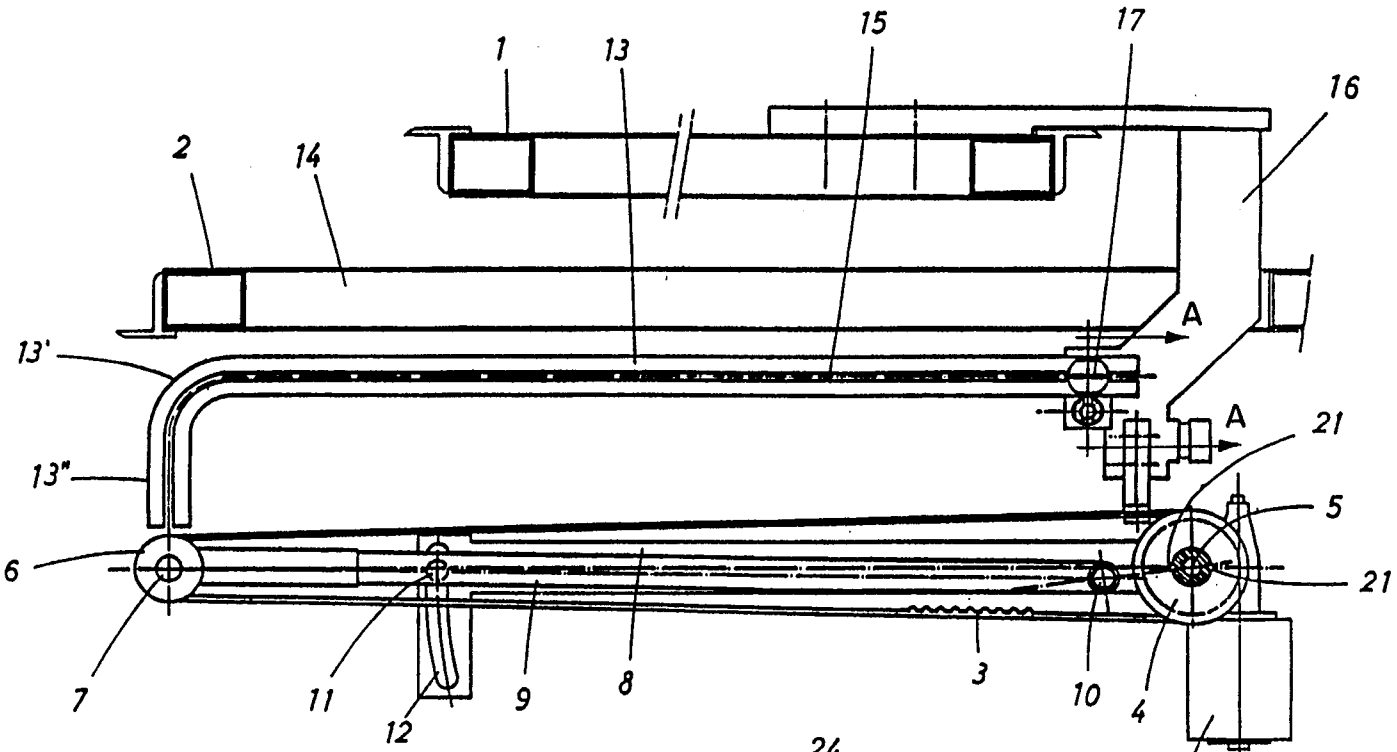

As shown in FIGS. 3 and 6, the belt 3 is operated by an electric motor 19 of any type through a suitable transmission for reducing its rotational speed, the motor 19 being coupled to the fixed pulley 4 and preferably mounted to the same fixed support 8 as the pulley 4. The coupling between the driving axle 5 and the fixed pulley 4 is effected through a clutch system which can in the event of failure be operated from the interior of the vehicle, so as to allow manual operation of the door 1. The clutch system comprises a disc 20 permanently in rotational engagement with the driving axle 5 by means of a toothed wheel 21, the disc 20 being able to slide between limits along the axle 5 so as selectively to engage with, or disengage from, the pulley 4 through a system of radial teeth 22. The movable disc 20 is operated through a fork 23 (FIG. 1) which fits into a peripheral channel in the wheel 20 provided for this purpose, by a lever (not shown) which is controlled, in its turn, from the interior of the vehicle, through any suitable remote-control system (cable, rods, sets of levers, etc.). Raising the wheel 20 separates it from the pulley 4, in order to nullify the automatic operating system.

Along all, or at least a part, of the guide 13 there is arranged a projecting flange 24 (see FIG. 5) integral with the guide 13 and against which the end of the axle of the outer guide roller 18 abuts, preventing any rocking movement of the door 1.

Figure 2:
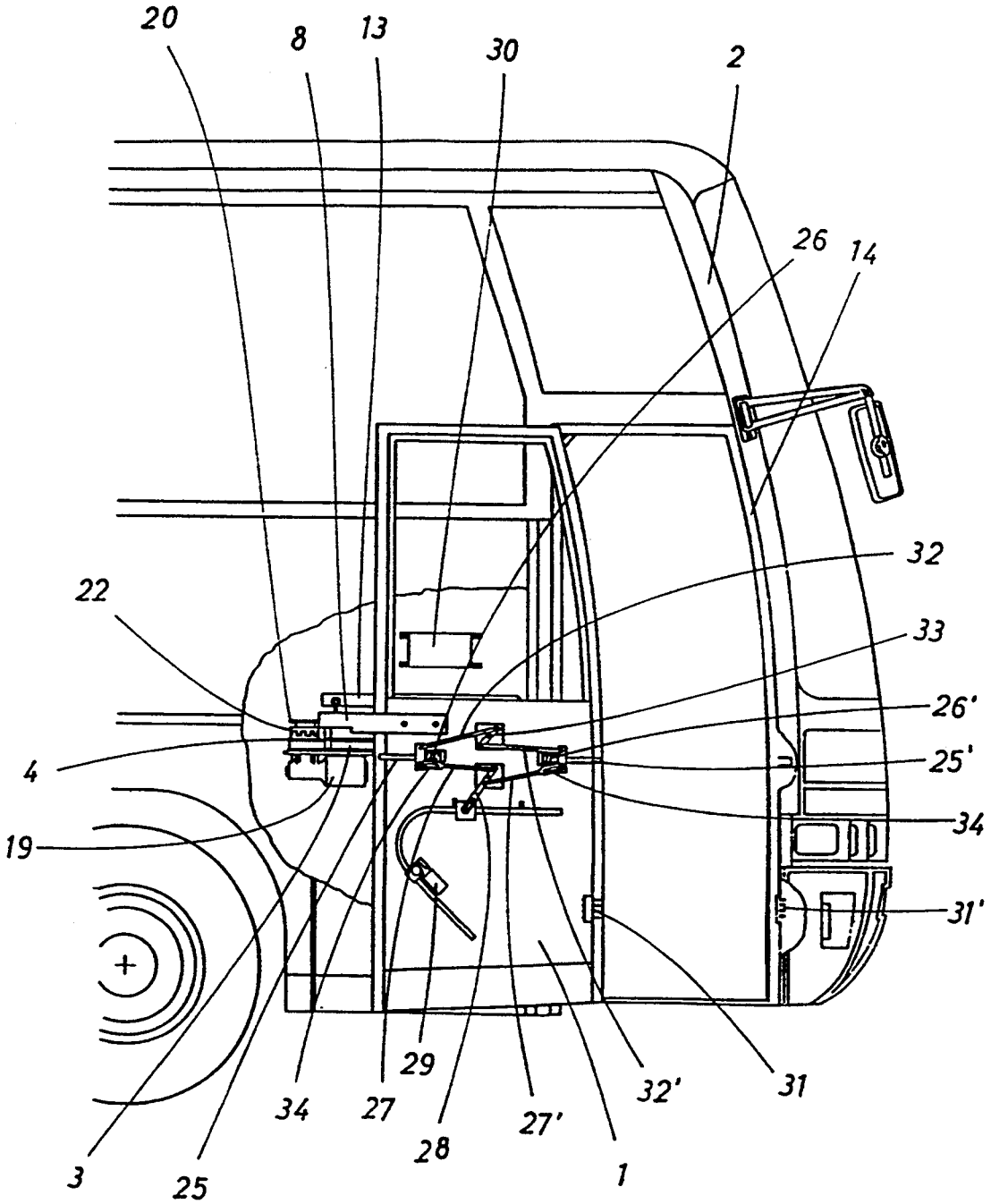
FIG. 2 is a side view similar to FIG. 1, but with the door shown in the open position.

The door is locked in the closed position by means of two opposed bolts 25, 25', which fit into corresponding recesses provided in the fixed frame 14. The bolts are biased towards the closed position by springs 26, 26' and can be separated from this position by means of arms 27, 27', which are hinged at their ends to a lever 28 The movements of the lever 28 are controlled, through any suitable transmission system (for example, by means of the cable, spindle and rod arrangement shown in FIGS. 1 and 2), by means of an auxiliary electric motor 29.

The supply circuits for the two electric motors 19 and 29 are controlled by an electronic box 30, the control member of which is situated at any point which is conveniently accessible from the driving seat. Following techniques known per se, the assembly is arranged so that, the door 1 being presumed to be in the closed position, with the bolts 25, 25, lodged in the corresponding recesses, operating the control member in order to open the door actuates the electric motor 29 for a short initial phase regulated by a timer, causing the lever 28 to rotate in the direction of the arrow "a" (FIG. 1) whereby the arms or tie-rods 27, 27, bring about the return movement of the bolts, 25, 25', separating them from the recesses and unlocking the door. After that the main electric motor 19 comes into operation, which slides the door 1 along the guides, first moving it away from the side of the bodywork 2 (moving the rollers along the transverse section 13'' of the guide 13) and then causing it to slide longitudinally along the side of the bodywork 2, until it reaches the fully opened position, at which point a limit switch stops the motor.

If, with the door 1 in the open position, the control member is operated in order to close the door the electric motor 19 comes into operation first, sliding the door 1 along the longitudinal section 13 of the guide and then along the curved section 13', and the final transverse section 13'', until the door is applied with a certain pressure against the fixed frame 14. On this latter position being reached, a set of fixed contacts 31, 31', stop the main motor 19 and start the auxiliary motor 29, bringing about rotation of the lever 28 in the opposite direction to the arrow "a" and allowing the bolts 25, 25', urged by the springs 26, to fit into the corresponding recesses locking the door in the closed position.

The electronic box 30 comprises means which detect the load of the main motor 19, so that, when a resistance of a value greater than a predetermined one opposes the closure movement of the door 1 (in the event of any obstacle preventing the closure), the direction of revolution of the same is reversed, bringing about the movement in the opposite direction of the door 1. These means are cancelled by the contacts 31, 31', so that, as the door 1 reaches the closed position, the said reversal of movement does not take place, and the auxiliary electric motor 29 comes into operation.

The bolts 25, 25', can also be operated manually from inside the vehicle to allow manual opening of the door 1, in the event of failure of the automatic operating system. The manual control mechanism comprises two tie-rods, 32, 32' which are actuated by a lever 33. The lever 33 may be rotated by means of a crank handle (not shown) which is accessible from inside the vehicle and which may be integral with the lever 33 or which may be releasably attached thereto. The arms 27, 27', are provided at their ends with slotted holes 34, to allow this movement to be freely effected with the arms 27, 27' remaining in the closed, or locked, position. It is also possible to provide a transmission system to actuate the lever 33 from the outside of the vehicle, acting on a control member which is suitably marked, in order to unlock the door. Such an arrangement is a statutory requirement in order that the door is capable of being opened in the event of an accident. Means may also be provided so as to ensure that the transmission system may be rendered inoperable so that the door may be secured in the closed position when the vehicle is parked.

I claim:

1. Apparatus for automatic opening and closure of a sliding door relative to a door frame of the type in which movement of the door between open and closed positions comprises a longitudinal movement substantially parallel to the door frame and a transverse movement perpendicular thereto, the apparatus comprising an endless drive belt, coupling means connecting the door to the belt and drive means for moving the belt to effect opening and closure of the door, wherein the belt extends between two pulleys including a first pulley having an axle which is fixed in relation to the door frame and a second pulley having an axle mounted for movement along an arcuate path towards and away from the door frame.

2. Apparatus as claimed in claim 1 wherein the axle of the second pulley is carried on a member which is pivoted with respect to the door frame about a pivot axis.

3. Apparatus as claimed in claim 2 wherein said member has a configuration wherein, with the door in the closed position, the axles of the first and second pulleys and the pivot axis about which the member pivots are in alignment.

4. Apparatus as claimed in claim 3 comprising an arcuate slot in a support associated with the door frame and a pin mounted to the member, the pin being constrained to move along the slot.

5. Apparatus as claimed in claim 1 wherein the drive means includes a motor for driving the first pulley.

6. Apparatus as claimed in claim 5 including a clutch between the motor and the first pulley whereby the door may be operated manually by release of the clutch.

7. Apparatus as claimed claim 1 including a guide fixed in relation to the door frame and along which the coupling means is constrained to move.

8. Apparatus as claimed in claim 7 wherein the guide comprises a hollow slotted section and wherein the coupling means comprises at least one roller fitted within the guide, the guide being formed with a longitudinal section, an arcuate section of about 90° and a transverse section.

9. Apparatus as claimed in claim 8 including a second roller mounted to the coupling means positioned to roll along an outer surface of the guide.

10. Apparatus as claimed in claim 9 wherein the guide is provided along at least a part of its length with an external flange against which the axle of the second roller abuts for preventing vertical movement of the door.

11. Apparatus as claimed in claim 1 including locking means for locking the door in the closed position.

12. Apparatus as claimed in claim 11 wherein the locking means comprises a pair of mutually opposed bolts on the door which may be moved outwardly, parallel to the plane of the door, to seat within complementary recesses in the door frame.

13. Apparatus as claimed in claim 11 including means for operating the locking means automatically on opening or closing the door.

14. Apparatus as claimed in claim 11 wherein means is provided for operating the locking means manually.

* * * * *